US006237465B1

(12) United States Patent
Forster et al.

(10) Patent No.: US 6,237,465 B1
(45) Date of Patent: May 29, 2001

(54) AXIAL PISTON MACHINE WITH CURVED BEARING SURFACE ON THE DRIVE PLATE

(75) Inventors: Franz Forster, Karlstadt-Muhlbach; Karl Sprenger, Sulzbach, both of (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/339,336

(22) Filed: Jun. 23, 1999

(30) Foreign Application Priority Data

Jun. 29, 1998 (DE) ..... 198 28 939

(51) Int. Cl.[7] ..... F04B 1/20
(52) U.S. Cl. ..... 92/71; 92/129
(58) Field of Search ..... 92/12.2, 71, 129

(56) References Cited

U.S. PATENT DOCUMENTS

| | | | | |
|---|---|---|---|---|
| 1,882,632 | * | 10/1932 | Jaworowski | 92/71 X |
| 2,374,595 | * | 4/1945 | Franz | 92/71 X |
| 3,233,550 | * | 2/1966 | Smith | 92/12.2 X |
| 4,741,251 | * | 5/1988 | Hayashi et al. | 92/57 |
| 5,554,009 | * | 9/1996 | Ohta et al. | 417/269 |
| 6,092,457 | * | 7/2000 | Inoue et al. | 92/129 |

* cited by examiner

*Primary Examiner*—John E. Ryznic
(74) *Attorney, Agent, or Firm*—Webb Ziesenheim Logsdon Orkin & Hanson, P.C.

(57) ABSTRACT

An axial piston machine includes a plurality of reciprocating pistons, each of which can move longitudinally in a cylinder bore and is supported on a bearing surface of a drive plate. The drive plate is oriented so that it forms a tilt angle with respect to a transverse plane that is perpendicular to the axis of rotation of the axial piston machine. The bearing surface, viewed in the direction of the longitudinal center plane of the axial piston machine, is provided at least in the vicinity of the reciprocating piston that extends the farthest out of the cylinder bores with a concave, in particular spherical, curvature. As a result, taking advantage of the allowable material loads at a constant maximum allowable transverse force on the piston, the tilt angle of the drive plate (1) can be increased. Consequently, the geometric volume flow of the axial piston machine and thus its delivery can also be increased. The curvature of the bearing surface is designed so that the surface pressures of the reciprocating pistons in the cylinder bores and/or the deflections of the reciprocating pistons that occur during operation differ from each another by not more than 20%. The tilt angle of the drive plate is between 20 and 30 degrees.

20 Claims, 1 Drawing Sheet

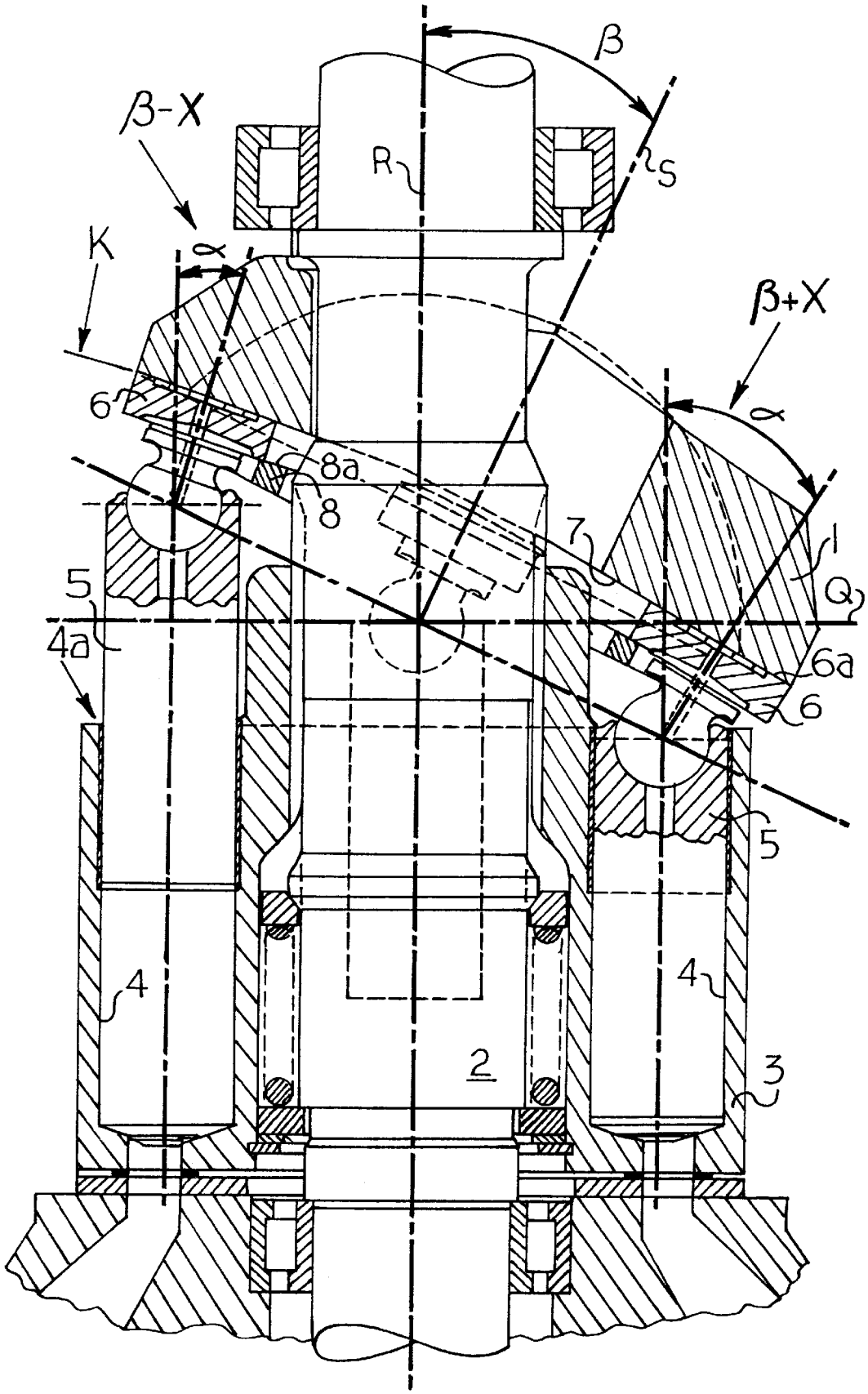
β
β-X
R
S
K
α
β+X
α
6
8a
8
7
1
5
Q
4a
6a
6
5
4
4
2
3

AXIAL PISTON MACHINE WITH CURVED BEARING SURFACE ON THE DRIVE PLATE

BACKGROUND OF THE INVENTION

1. Field of the Invention

This invention relates to an axial piston machine with a plurality of reciprocating pistons, each of which is located so that it can move longitudinally in a cylinder bore and is supported on a bearing surface of a drive plate, whereby the drive plate is oriented at an angle with respect to a transverse plane that is a perpendicular to the axis of rotation of the axial piston machine, thereby forming a tilt angle.

2. Background Information

The prior art includes axial piston machines in a variety of configurations. There are essentially two main groups of axial piston machines: wobble plate construction and swash plate construction. In the axial piston machines that utilize the wobble plate construction, the drive plate rotates, while the cylinder bores in which the respective longitudinally movable reciprocating pistons are located and fixed stationary in relation to the housing. In axial piston machines that utilize the swash plate construction, the drive plate does not rotate in the housing of the axial piston machine, while the cylinder bores of the reciprocating pistons are located in a rotating cylinder drum. Both groups of axial piston machines exist both with a variable and with a constant tilt angle of the drive plate. Theoretically, both groups of axial piston machines can be used as a pump or as a motor.

The size of the stroke of the reciprocating pistons is the determining factor for the volume flow of the axial piston machines, and thus for their performance. The stroke is a function of the tilt angle of the drive plate and increases as the tilt angle increases.

The level of the acceptable stresses in t material (surface pressure, piston deflection) represents the limiting factor for the maximum allowable transverse force on the piston. The maximum transverse force on the piston occurs when the force is split on the drive plate between a longitudinal and transverse force on the piston at the acceptable maximum tilt angle of the drive plate at a specific maximum operating pressure of the axial piston machine. The decisive factor is thereby always the reciprocating cylinder that is extended farthest from its cylinder hole and is exposed to the maximum operating pressure. In particular, high stresses can occur on the edges of the cylinder bore and the reciprocating piston.

To increase the delivery of the axial piston machine, the simplest approach would be to increase the tilt angle of the drive plate. Such an increase, however, would have a disproportional effect on the load on the reciprocating piston because, not only is the transverse force on the piston increased as a function of the tilt angle, but also as a result of the fact that the reciprocating piston is extended farther out of the cylinder bore, a correspondingly increased tilting moment is applied to the extended lever arm.

On the axial piston machines of the prior art, the tilt angle is, therefore, not more than 18 degrees to 20 degrees.

SUMMARY OF THE INVENTION

The object of the present invention is to make available an axial piston machine of the type described above that combines compact size with a high delivery capacity.

The present invention provides an axial piston machine with a bearing surface having a concave curvature when viewed in the direction of the longitudinal center plane of the axial piston machine, at least in the vicinity of the reciprocating piston that is extended farthest out of the cylinder bores.

The concave bearing surface means that the transverse force that is exerted on the reciprocating piston that extends the farthest out of its cylinder bore and is under operating pressure, and which results from the splitting of the forces at the point of support of the reciprocating piston on the bearing surface of the drive plate, is determined not only by the tilt angle of the drive plate, but also by the curvature of the bearing surface. Therefore, as a result of the inclusion of the curvature of the bearing surface, the support angle of the reciprocating piston on the bearing surface of the drive plate is smaller than the tilt angle of the drive plate.

Consequently, at the same tilt angle of the drive plate, the transverse force exerted on the reciprocating piston that is extended farthest out of its cylinder bore is reduced. Conversely, the present invention teaches that this fact can be taken advantage of so that with the same maximum possible transverse force on the piston, i.e., with the utilization of the maximum allowable material loads, the tilt angle of the drive plate can be increased, and thus the delivery of the axial piston machine of the present invention can be significantly increased.

In one embodiment of the present invention, the curvature of the bearing surface is designed so that the surface pressures of the reciprocating pistons in the cylinder bores and/or the deflections of the reciprocating pistons that occur during operation differ from each other by not more than 20%, and in particular by not more than 10%. In this manner, there is a uniform load on all the reciprocating pistons and cylinder bores.

The axial piston machine of one embodiment of the present invention includes the tilt angle of the drive plate between 20 degrees and 30 degrees. This axial piston machine has small outside dimensions and a large geometric volume flow, and thus a high delivery capacity. As a result of the curvature of the bearing surface, the loads on the reciprocating pistons and cylinder bores are lower than in propulsion systems of the prior art.

The invention can be applied to different type of axial piston machines, theoretically regardless of how the reciprocating piston is supported on the bearing surface of the drive plate. For example, the reciprocating piston can be supported on the bearing surface by spherical heads or slippers. In one embodiment of the present invention, the reciprocating pistons are supported on the bearing surface of the drive plate by slippers, whereby the slide face of the piston facing the drive plate has a convex curvature in particular a spherical curvature. The radius of curvature of the convex slide face is essentially equal to the radius of curvature of the concave bearing surface of the drive plate. This slipper design can absorb high loads and, therefore, makes possible a high operating pressure, which in turn results in a high delivery capacity of the axial piston machine of the present invention. The slipper can be appropriately pressed toward the bearing surface of the drive plate by a hold-down plate. The end surface of the hold-down plate that faces the slippers has a convex curvature, in particular a spherical curvature.

Additional advantages and details of the present invention are explained in greater detail below with reference to the exemplary embodiment illustrated in the accompanying schematic drawing.

BRIEF DESCRIPTION OF THE DRAWING

The accompanying drawing shows a section through an adjustable axial piston machine constructed using the drive plate design, viewed along its longitudinal center plane. The longitudinal center plane extends along the axis of rotation R of the axial piston machine, and is oriented perpendicular to a bearing surface of the drive plate. The longitudinal center plane is thus the plane in which the tilt angle of the drive plate is illustrated.

DESCRIPTION OF THE PREFERRED EMBODIMENTS

A non-rotating drive plate 1 is operated in the manner of the prior art by a rotating drive shaft 2, with which a cylinder drum 3 is non-rotationally connected. The cylinder drum 3 contains a plurality of concentric cylinder bores 4, in each of which there are respective reciprocating pistons 5. Each reciprocating piston 5 is supported on a bearing surface 7 of the drive plate 1 by a ball bearing system and a slipper 6.

The reciprocating movement of the reciprocating pistons 5 is caused by the diagonal position of the drive plate 1, which is tilted at an angle with respect to a transverse plane Q that is perpendicular to the axis of rotation R. This tilt angle β is also present for geometric reasons between the axis of rotation R and a plane S which is perpendicular to the bearing surface 7, and is illustrated there.

As a result of the support of the reciprocating piston 5 on the angled drive plate 1, transverse forces are generated on the reciprocating pistons 5 and are directed upward in the figure. The transverse force on the pistons 5 are a result of the splitting of the forces on the bearing surface 7 between forces directed longitudinally along the pistons 5 and forces directed transverse to the piston 5. The splitting of the force is a function of the support angle at which the reciprocating pistons 5 or the slippers 6 are in contact against the bearing surface 7 of the drive plate 1.

On axial piston machines of the prior art that have a plane bearing surface on the drive plate, the support angle is identical to the tilt angle β of the drive plate 1.

The transverse force on the pistons generate surface pressures and deflections of the reciprocating pistons 5. The reciprocating piston 5 that extends farthest out of its cylinder bore 4 and is exposed to the operating pressure is thereby exposed to the greatest load. The greatest loads in terms of surface pressure are at the outer end 4*a* of its cylinder bore 4. The material load at that point, at a given operating pressure of the axial piston machine, determines the maximum possible tilt angle β of the drive plate 1, which is 18 to 20 degrees the axial piston machines of the prior art.

The present invention provides that the bearing surface 7 of the drive plate 1 has a concave curvature at least in the vicinity of the reciprocating piston 5 that extends farthest out of the cylinder bores 4. In the exemplary embodiment illustrated, this curvature is realized in the form of a spherical curvature that has a radius of curvature K.

As a result of the curvature of the bearing surface 7, when the forces are split on the bearing surface 7, the influencing factors include not only the tilt angle β alone, but also an angle X that results from the curvature of the bearing surface 7. For the reciprocating piston 5 that extends farthest out of its cylinder bore 4, the result, when the forces are split on the bearing surface 7, is a support angle α that results from the difference between the tilt angle β and the angle X, which is determined by the curvature of the bearing surface 7, and is consequently smaller than the tilt angle β.

Consequently, with an unchanged tilt angle β, as a result of the concave curvature of the bearing surface in the vicinity of the piston 5 that is extended farthest out of its cylinder bore 4, there is a reduced transverse force on the piston. By taking advantage of the allowable material loads, and with the same maximum possible transverse force on the piston 5, it becomes possible to increase the tilt angle 9 of the drive plate, which is equivalent to an increase of the geometric volume flow and thus to an increase in the delivery of the axial piston machine of the present invention.

The slide face 6*a* of the slippers 6 facing the drive plate 1 has a convex curvature, in particular spherical curvature. In this case, the radius of curvature of the convex slide face 6*a* is essentially equal to the radius of curvature K of the concave bearing surface 7 the drive plate 1.

The slippers 6 can be pressed toward the bearing surface 7 of the drive plate 1 by a hold-down plate 8. equalize the different inclinations of the slippers 6, the end surface 8*a* of the hold-down plate 8 next to the slippers 6 has a convex curvature, in particular a spherical curvature.

For the sake of completeness, it should be noted that when the bearing surface 7 is curved, as shown in the exemplary embodiment illustrated, a support angle x results for the reciprocating piston 5 that is inserted the farthest into its cylinder bore 4, which support angle is determined by the addition of the tilt angle β and the angle x determined by the curvature of the bearing surface 7. The support angle X is correspondingly larger than the tilt angle β. Consequently, an increased transverse force on the pistons 5 results for the inserted reciprocal piston 5. However, these forces are not critical with regard to the surface pressure and deflection loads of the reciprocating piston 5, because the reciprocating piston 5 is supported over its entire length in the cylinder bore 4 with respect to the transverse force on the piston 5.

For the most uniform possible loading of the cylinder drum 3 and of the reciprocating pistons 5, the curvature of the bearing surface 7 is preferably designed so that the surface pressures of the reciprocating pistons 5 in the cylinder bores 4 and/or the deflections of the reciprocating pistons 5 that occur during operation differ from each another by not more than 20%, and in particular by not more than 10%.

The axial piston machine claimed by the invention preferably has a maximum tilt angle β of the drive plate that extends up to 30 degrees, and is at least 20 degree and, therefore, is generally between 20 degrees and 30 degrees.

The above described embodiment is mere illustrative of the present invention and not restrictive thereof. It will be apparent that many modifications may be made to the present invention without departing from the spirit and scope thereof. The scope of the press invention is defined by the appended claims and equivalents thereto.

We claim:

1. An axial piston machine with a plurality of reciprocating pistons, each of which can move longitudinally in a cylinder bore and is supported on a bearing surface of a drive plate, whereby the drive plate is oriented so that it forms a tilt angle with a transverse plane that is perpendicular to the axis of rotation of the axial piston machine, wherein the bearing surface is provided with a concave curvature when viewed in the direction of the longitudinal center plane of the axial piston machine, at least in the vicinity of the reciprocating piston that extends farthest out of the cylinder bores, wherein the curvature of the bearing surface provides that the surface pressure of the reciprocating pistons in the cylinder bores that occur during operation differ from each other by not more than 20%.

2. The axial piston machine as claimed in claim 1, wherein the curvature of the bearing surface provides that the surface pressures of the reciprocating pistons in the cylinder bores that occur during operation differ from each other by not more than 10%.

3. The axial piston machine as claimed in claim 2, wherein the tilt angle of the drive plate is between 20 degrees and 30 degrees.

4. An axial piston machine with a plurality of reciprocating pistons, each of which can move longitudinally in a cylinder bore and is supported on a bearing surface of a drive plate, whereby the drive plate is oriented so that it forms a tilt angle with a transverse plane that is perpendicular to the axis of rotation of the axial piston machine, wherein the bearing surface is provided with a concave curvature when viewed in the direction of the longitudinal center plane of the axial piston machine, at least in the vicinity of the reciprocating piston that extends farthest out of the cylinder bores, wherein the curvature of the bearing surface provides that the deflections of the reciprocating pistons in the cylinder bores that occur during operation differ from each other by not more than 20%.

5. The axial piston machine as claimed in claim 4, wherein the curvature of the bearing surface provides that the deflections of the reciprocating piston that occur during operation differ from each other by not more than 10%.

6. The axial piston machine as claimed in claim 5, wherein the bearing surface of the drive plate has a spherical curvature.

7. An axial piston machine with a plurality of reciprocating pistons, each of which can move longitudinally in a cylinder bore and is supported on a bearing surface of a drive plate, whereby the drive plate is oriented so that it forms a tilt angle with a transverse plane that is perpendicular to the axis of rotation of the axial piston machine, wherein the bearing surface is provided with a concave curvature when viewed in the direction of the longitudinal center plane of the axial piston machine, at least in the vicinity of the reciprocating piston that extends farthest out of the cylinder bores, wherein the reciprocating pistons are supported on the bearing surface of the drive plate by slippers having slide faces, and the slide faces of the slippers facing the drive plate have a convex curvature.

8. The axial piston machine as claimed in claim 7, wherein the curvature of the bearing surface provides that the surface pressures of the reciprocating pistons in the cylinder bores that occur during operation differ from each other by not more than 20%.

9. The axial piston machine as claimed in claim 7, wherein the tilt angle of the drive plate is between 20 degrees and 30 degrees.

10. The axial piston machine as claimed in claim 7, wherein the radius of curvature of the convex slide face is essentially equal to the radius of curvature of the concave bearing surface of the drive plate.

11. The axial piston machine as claimed in claim 7, wherein the slippers can be pressed toward the bearing surface of the drive plate by a hold-down plate.

12. The axial piston machine as claimed in claim 11, wherein an end surface of the hold-down plate next to the slippers has a convex curvature, in particular a spherical curvature.

13. The axial piston machine as claimed in claim 12, wherein the end surface of the hold-down plate, the slide faces of the slippers and the bearing surface of the drive plate have a spherical curvature.

14. The axial piston machine as claimed in claim 7, wherein the slide faces of the slippers and the bearing surface of the drive plate have a spherical curvature.

15. The axial piston machine as claimed in claim 7, wherein the bearing surface of the drive plate has a spherical curvature.

16. The axial piston machine as claimed in claim 7, wherein the curvature of the bearing surface provides that the deflections of the reciprocating piston that occur during operation differ from each other by not more than 20%.

17. The axial piston machine as claimed in claim 7, wherein the curvature of the bearing surface provide that the deflections of the reciprocating piston that occur during operation differ from each other by not more than 10%.

18. The axial piston machine as claimed in claim 1, wherein the curvature of the bearing surface provides that the surface pressures of the reciprocating pistons in the cylinder bores that occur during operation differ from each other by not more than 10%.

19. The axial piston machine as claimed in claim 7, wherein the tilt angle of the drive plate is at least 20 degrees.

20. The axial piston machine as claimed in claim 7, wherein a maximum tilt angle of the drive plate can extend up to 30 degrees.

* * * * *

UNITED STATES PATENT AND TRADEMARK OFFICE

CERTIFICATE OF CORRECTION

PATENT NO. : 6,237,465 B1
DATED : May 29, 2001
INVENTOR(S) : Franz Forster et al.

It is certified that error appears in the above-identified patent and that said Letters Patent is hereby corrected as shown below:

Column 1,
Line 35, "in t material" should read -- in the material --.

Column 2,
Line 40, "different type" should read -- different types --.

Column 3,
Line 43, after "material load" insert -- allowed --.

Column 4,
Line 3, "titl angle 9" should read -- tilt angle β --.
Line 13, "8. Equalize" should read -- 8. To equalize --.
Lines 19 and 22, "angle x" should read -- angle X --.
Line 41, after "drive plate" insert -- 1 --.
Line 42, "20 degree" should read -- 20 degrees --.

Column 6, claim 17,
Line 31,"bearing surface provide" should read -- bearing surface provides --.

Column 6, claim 18,
Line 34, "in claim 1" should read -- in claim 7 --.

Signed and Sealed this

Nineteenth Day of February, 2002

*Attest:*

*Attesting Officer*

JAMES E. ROGAN
*Director of the United States Patent and Trademark Office*